US007367160B2

(12) United States Patent
Mullet et al.

(10) Patent No.: US 7,367,160 B2
(45) Date of Patent: May 6, 2008

(54) DOOR OPERATOR SYSTEM

(75) Inventors: Willis J. Mullet, Gulf Breeze, FL (US); Donald B. Kyle, Pace, FL (US); David B. Davies, Pace, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 562 days.

(21) Appl. No.: 10/828,949

(22) Filed: Apr. 21, 2004

(65) Prior Publication Data

US 2005/0235563 A1 Oct. 27, 2005

(51) Int. Cl.
*E05F 11/00* (2006.01)

(52) U.S. Cl. ..... 49/199; 49/197; 49/200; 160/188

(58) Field of Classification Search ..... 49/197, 49/199, 200; 160/188, 189, 201
See application file for complete search history.

(56) References Cited

U.S. PATENT DOCUMENTS 4,191,237 A * 3/1980 Voege ..... 160/188
5,040,332 A 8/1991 Aquilina ..... 49/200
5,222,327 A 6/1993 Fellows et al. ..... 49/139
5,557,887 A 9/1996 Fellows et al. ..... 49/28
5,698,073 A 12/1997 Vincenzi ..... 160/188
5,803,149 A 9/1998 Halley et al. ..... 160/201
5,931,212 A 8/1999 Mullet et al. ..... 160/188
6,561,255 B1 5/2003 Mullet ..... 160/188
6,568,454 B1 5/2003 Mullet et al. ..... 160/188
6,588,156 B2 * 7/2003 Mullet ..... 49/506
6,739,372 B2 * 5/2004 Mullet et al. ..... 160/189
6,845,804 B2 * 1/2005 Mullet ..... 160/188
6,851,465 B2 * 2/2005 Mullet et al. ..... 160/188
6,880,609 B2 * 4/2005 Mullet et al. ..... 160/188

* cited by examiner

*Primary Examiner*—Jerry Redman
(74) *Attorney, Agent, or Firm*—Renner Kenner Greive Bobak Taylor & Weber

(57) ABSTRACT

An operator for use in connection with a door system including an axle having an operator framework supporting an operator motor, the operator framework defining a clearance adapted to insertably receive the axle therein, a gear assembly defining a bore in which the axle is received and including a removable gear segment adapted to selectively medially open the bore to receive the axle, wherein the motor is interconnected with the gear assembly to cause rotation thereof.

17 Claims, 6 Drawing Sheets

DOOR OPERATOR SYSTEM

TECHNICAL FIELD

The present invention relates generally to upwardly acting barriers and, more particularly, to an operator system used to raise and lower upwardly acting doors. Most particularly, the present invention relates to an operator system that interacts with the axle of a counterbalance system to raise and lower a sectional door.

BACKGROUND ART

In the upwardly acting door art, the door system typically includes a counter-balance assembly that is capable of generating a force to suitably offset the weight of the door, such that the door may be raised or lowered without undue effort from a person manually opening the door or a motorized operator system used to raise and lower the door. Typical counterbalance systems include an axle, which may be either a solid shaft or tube, having a torsion spring mounted thereon and interconnected with the door. The spring is tensioned to provide the appropriate variable counterbalancing force for the weight of the door where the door moves between a closed vertical position and an open horizontal position. In door systems using a motorized operator, it is common to use an operator mounted on the ceiling of the structure having a track extending toward the door and a trolley, which rides on the track, attached to the door to raise and lower the door by applying force directly to the door. It is also known to employ a "jack shaft" operating system that interacts with the counterbalance system to raise and lower the door. A jack shaft type operator has the advantage of eliminating the need for head space within the structure ordinarily occupied by a trolley-type operator and otherwise providing a more compact door system.

One known door design includes a jack shaft-type operating system for controllably moving in upward and downward directions a sectional door in relation to a door frame having a pair of jambs and an interconnecting header, including a counterbalance system having a drive tube interconnected with the sectional door proximate the ends thereof, a motorized operator mounted adjacent to the drive tube and between the ends of the sectional door and a drive train interconnecting the drive tube and the motorized operator for selectively driving the sectional door in upward and downward directions. The operator includes a motor for selectively rotating a drive shaft in two directions, a drive wheel on the drive shaft for rotating the drive train in one direction when the motor rotates the drive shaft in one direction, and a coupler on the drive shaft rotating the drive wheel when located in a first position and directly engaging and rotating the drive gear in the other direction when located in a second position. The design of this system extends a torque tube through the operator housing and is best installed during initial installation. To retrofit this operator to an existing door system, the tension must be removed from the counterbalance system and the counterbalance system must be disassembled to allow the torque tube to be extended axially through the operator housing. Afterward, the counterbalance system must be reassembled and tension reapplied to the counterbalance spring.

In another known design, a jack shaft garage door operator is used for positively opening and closing a garage door and includes a jack shaft garage door operator drive having an electric motor. The motor is connected to a jack shaft garage door operator transmission. The transmission includes an opening flexible link storage unit or cable drum having an open flexible link cable drive wrapped around it.

Also connected to the jack shaft is a second cable drum having a closing flexible link or closing cable wound in the opposite direction from the opening cable. A compressive force transmitting member, which includes a quick turn bracket, couples the closing cable to the garage door and is itself connected to an upper portion of the garage door to transmit a positive closing force to the garage door throughout its entire travel as the closing cable is drawn in and the opening cable is paid out under the operation of the electric motor. While this device appears to have the ability to be installed without removing tension from and disassembling the counterbalance system, it requires a substantial amount of side room adjacent the door opening to install the operator on the end of the drive tube. Depending upon the length of drive tube extending outside the drive tube support bearing, one may need to provide an extension or replace the drive tube with a longer tube to retrofit this operator.

In yet another design known in the industry, an operator system for a counterbalanced door includes a rodless fluid cylinder that has a cylinder body and rodless piston adapted for reciprocation in the cylinder body. A carriage, which is adapted for reciprocation externally along the length of the cylinder body, is secured to the piston. A link member connects the cylinder carriage to a door or to a torsion bar for the door. A control circuit is provided for controlling the operation of the fluid cylinder and hence, the position of the door. This pneumatic system requires the torque tube to be inserted through the drive portion of the operator requiring the counterbalance system to have the tension removed and disassembled to facilitate installation.

In still another design known in the industry, an automatic opener for a sectional door includes a drive unit mounted adjacent to the door drive shaft having a reversible motor, a gear linkage for translating rotation of the motor drive shaft into rotation of the sectional door drive shaft, and a clutch which permits the gear linkage to be manually temporarily disengaged from the motor drive shaft. The drive unit is supported within a housing that is connected to an adjustable wall bracket mounting base that is fixed to a wall adjacent the sectional door. A spring biased lever attached near a lower end of the sectional door pivots in response to slack in a door cable to automatically lock the door when it is completely shut. The locking mechanism automatically unlocks the door either when the drive unit is actuated to open the sectional door or when the clutch is utilized to disengage the gear linkage from the motor drive shaft. Chains and sprockets are used to transmit power from the operator to the torque tube. Unless the counterbalance system is installed with the driven gear in place, the counterbalance system must have the tension removed and disassembled to install the operator.

Therefore, it is desirable to have a compact operator that does not require additional space outside the confines of an ordinary counterbalance system and may be retrofitted to an existing door system without disassembling the system's counterbalance system.

DISCLOSURE OF THE INVENTION

It is therefore an object of the present invention to provide an operator that fits within the confines of an ordinary counterbalance system in not requiring additional head room or side room. Another object of the invention to provide such an operator that may be retrofitted to an existing counterbalance system without disassembling the counterbalance system. A further object of the invention is to provide such an operator which will fit all standard residential torsion spring systems.

Another object of the present invention is to provide an operator which does not require chains, sprockets, drive tube extension, adaptors or other ancillary components. Yet a further object of the invention is to provide such an operator which does not attach to the counterbalance system torsion springs or spring pad. A still further object of the invention is to provide such an operator which is relatively inexpensive and can be quickly and easily installed, thereby minimizing retrofit expense.

In light of at least one of the foregoing objects, the present invention generally contemplates an operator for use in connection with a door system including an axle having an operator framework supporting an operator motor, the operator framework defining a clearance adapted to insertably receive the axle therein, a gear assembly defining a bore in which the axle is received and including a removable gear segment adapted to selectively medially open the bore to receive the axle, wherein the motor is interconnected with the gear assembly to cause rotation thereof.

BEST MODE FOR CARRYING OUT THE INVENTION

Figure 1:
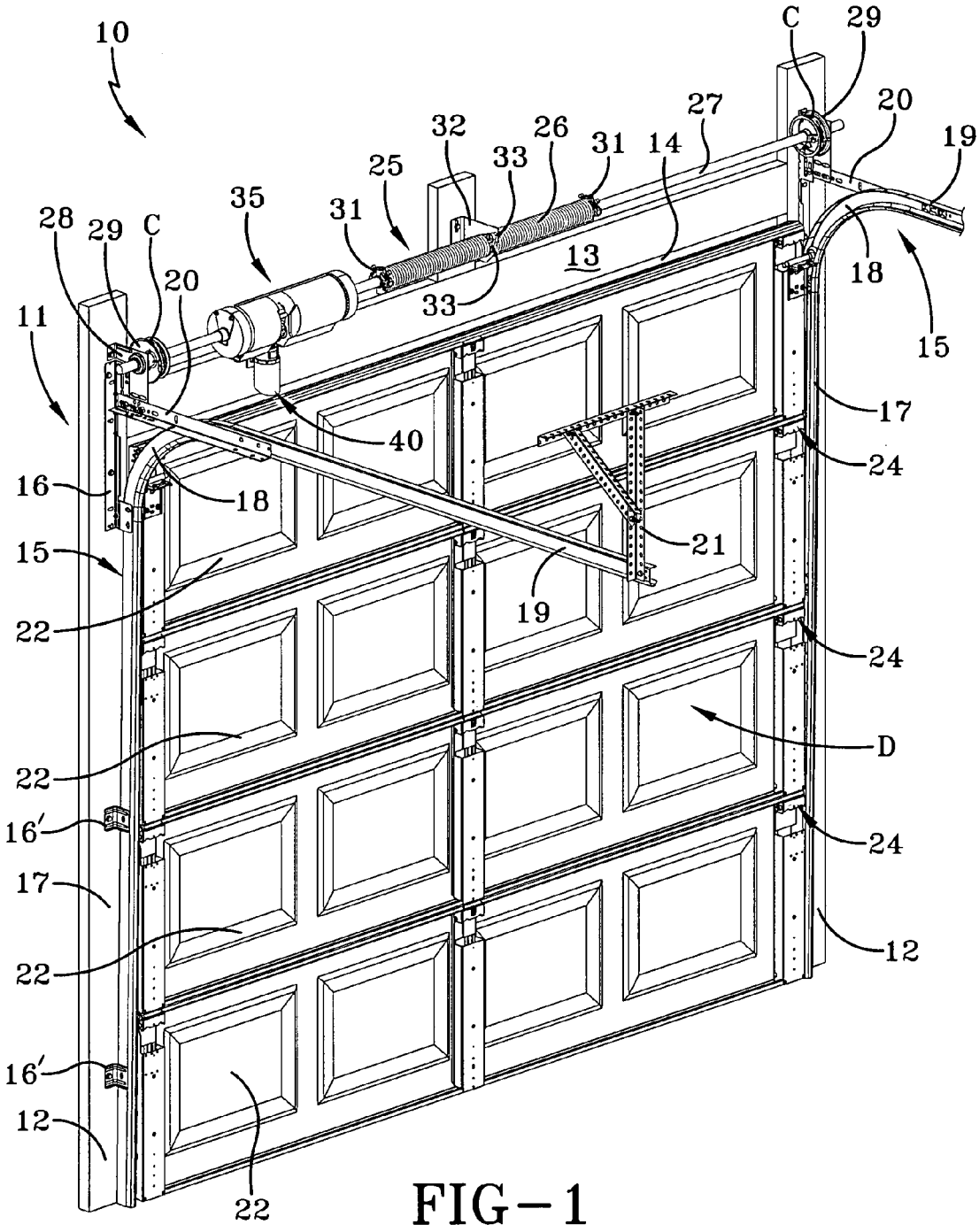
FIG. 1 is a rear perspective view of a door system including a jack shaft operator according to the concepts of the present invention mounted on the counterbalance shaft and housed within the confines of the counterbalance system.

A door system, generally indicated by the numeral 10, is shown in FIG. 1. Door system 10 may be mounted on a framework, generally indicated by the numeral 11, that includes a pair of upstanding jambs 12 interconnected near their vertical upper extremities by a header 13. The generally inverted U-shaped framework 11 defines an opening 14 between the jambs 12 and header 13. Track assemblies, generally indicated by the numeral 15, may be mounted on the framework 11, for example, as by flag angles 16 and brackets 16' that are fastened to jambs 12. Track assemblies 15 each include a generally vertical track section 17, a transitional track section 18 extending upwardly and rearwardly from the vertical track section 17 transcending an arc and joining the vertical section 17 to a rearwardly extending generally horizontal track section 19. Additional support for the horizontal track section 19 may be provided in the form of horizontal angles 20 extending rearwardly from the header and hangers 21 located proximate the distal end of the horizontal track section 19 and attached to the overhead structure (not shown).

A door, generally indicated at D, is located between the track assemblies 15 and guided between open and closed positions thereby. The door D, depicted in FIG. 1, is shown in a closed vertical position and includes a plurality of sections 22 that are pivotally connected to each other by hinge assemblies, generally indicated by the numeral 24.

A counterbalance system, generally indicated by the numeral 25, provides a counterbalancing force partially offsetting the weight of the door D to facilitate raising and lowering of the door D in a manner known to persons skilled in the art. A counterbalance system 25 having coil springs 26 is shown by way of example, and should not be considered as limiting the present invention to use with this particular type of counterbalance system 25. Counterbalance system 25 generally includes a drive axle 27, which may be a solid axle or tubular axle (as shown), rotatably supported, as by support brackets 28 mounted to the framework 11. Cable drums 29 are mounted on axle 27 and rotatably fixed thereto, such that they rotate with the drive axle 27, and include a cable C wound thereon and attached to the door D to effect transfer of the counterbalancing force generated by the coil springs 26 to the door D. To that end, coil spring 26 is interconnected with the drive axle 27 at one end 31 and a fixed bracket 32 at its opposite end 33 to develop the counterbalancing force upon rotation of the axle 27. As shown, a pair of coil springs 26 may be located on either side of bracket 32 to provide the counterbalancing force; however, a single coil spring 26 may be employed in some instances. Thus, in a manner known to persons of ordinary skill in the art, the counterbalancing force is transferred to the door D through the axle 27 and cable drums 29 via cable C. In operation, the cable C is selectively wound and unwound as the door D is raised or lowered, respectively, maintaining the tension on the door D. As a result relatively little force is needed to operate the door D. Thus, the door D. may be manually operated or automatically operated by an operator as described herein.

Figure 2:
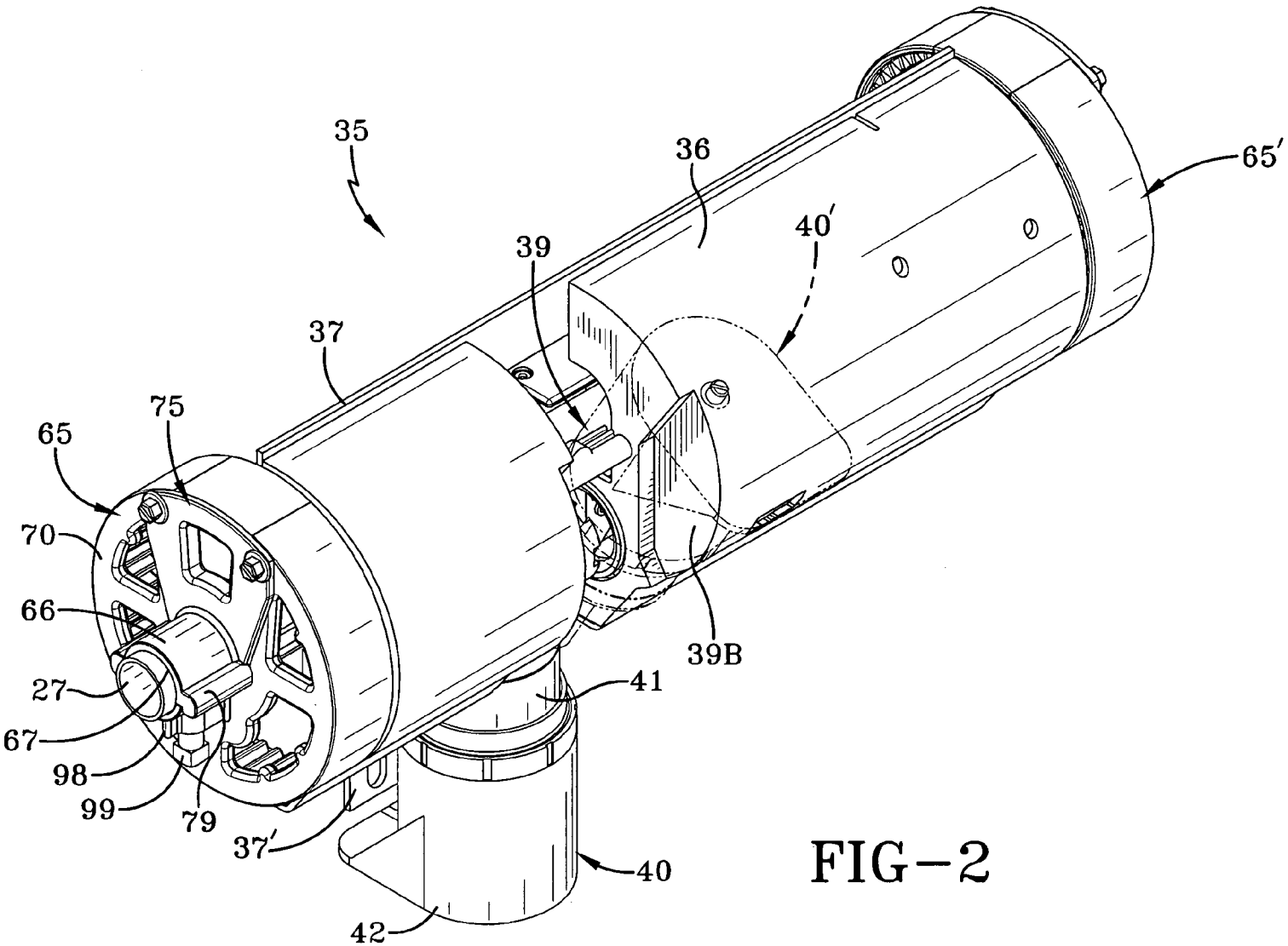
FIG. 2 is an enlarged perspective view of the operator of FIG. 1 depicting the operator installed on an axle extending through gear assemblies located at either end of the operator housing.

An operator according to the concepts of the present invention is generally indicated by the numeral 35. Operator 35 is mounted on the axle 27 and is operable therewith to raise and lower the door D. With reference to FIG. 2, operator 35 generally includes a housing 36 that receives axle 27 therethrough, such that the operator 35 may be located entirely between the track assemblies 15 without taking up additional space beyond the edges of the door D, as best shown in FIG. 1. The housing 36 may be in the form of a hollow shell that attaches to an operator framework 37 having a mounting bracket 37' that attaches the operator 35 to header 13 as by suitable fasteners (not shown). Housing 36 may be divided into first and second sections 36A, 36B, shown in FIG. 3, defining a gap, generally indicated by the numeral 39, therebetween to accommodate a pivoting motor assembly, generally indicated by the numeral 40. Motor assembly 40, which may include a conventional electric motor 41 that is designed for stop, forward and reverse rotation of the motor shaft and, in turn, the drive axle 27. As best seen in FIG. 4, sections 36A, 36B may be provided with one or more cutouts 38A, 38B to accommodate the components of operator 35 and may have laterally extending recessed portions 39A, 39B that increase the width of the gap 39 toward the rear of the housing 36.

Motor assembly 40 may be made pivotal between a generally rearward horizontally extending position shown as 40' in FIG. 2 and the downwardly vertically extending position in solid lines. It will be appreciated that a non-pivoting operator motor may be used in the operator 35 as well. As seen particularly in FIG. 2, the operator motor 40 may include a motor cover 42 that overlies the electric motor 41 and is generally cylindrical with a radial extension 45 (FIG. 5) adapted to engage a portion of the door D when the door D is in a closed vertical position. In this way, the motor assembly 40 provides a positive stop against forcible opening of the door D by an intruder, weather conditions or the like. Such contact further is advantageous in effecting sealing engagement of the door D with the door frame 11.

Figure 5:
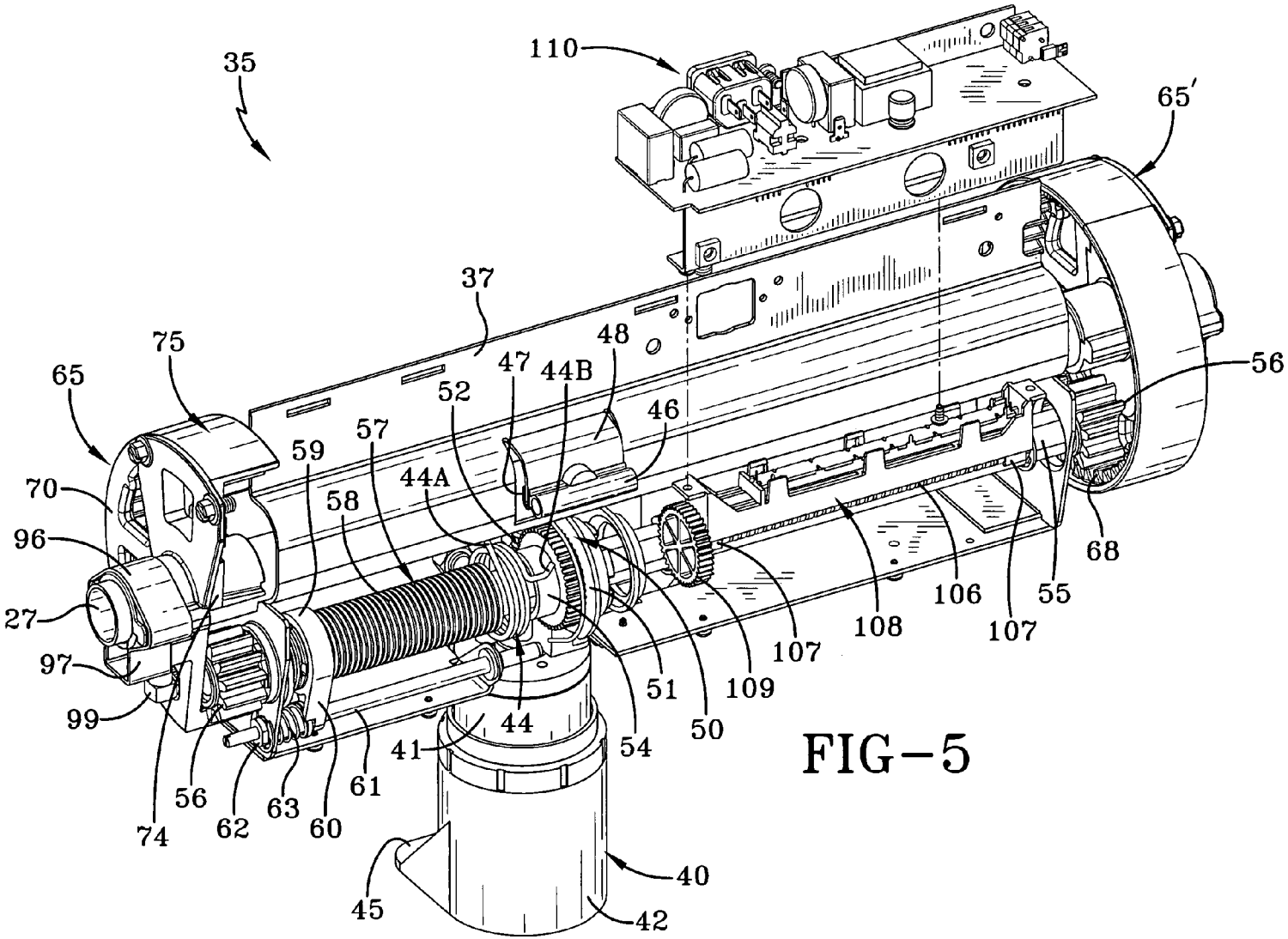
FIG. 5 is a perspective view similar to FIG. 4 with portions broken away and the control panels removed to show additional details of the operator.

As seen in FIG. 5, a helper spring, generally indicated by the numeral 44, may be provided to apply a torsional force to motor assembly 40 that assists in moving the motor 41 in moving smoothly throughout its angular operating range. In the example shown, helper spring 44 is located coaxially with the motor drive gear 56 and is tensioned to counterbalance the weight of the motor 41 at its heaviest position, which may generally be a horizontal motor axis position. The helper spring 44 may be attached to the housing 36 at one end 44A and to the motor 41 at its other end 44B and may be a coil spring, as shown, positioned concentric with the worm wheel 54. The pivoting of the motor 41 is effected by releasing rotary restraint and allowing the worm 52 of motor 41 to drive the motor 41 around the circumference of the mating worm wheel 54. Helper spring 44 provides a counter-rotary force equivalent to the motor weight to lift the motor 41 to the unlocked or driving position which otherwise may not provide sufficient counter-rotary force to lift the motor 41 in certain instances. As an added benefit, incorporation of the helper spring 44 simplifies manual disconnection of the operator 35. Helper spring 44 may bias motor 41 toward the unlocked position, Thus, when the operator 35 is manually disconnected, helper spring 44 automatically raises the motor 41 to the unlocked position. In this way, a conventional disconnect cable (not shown) need not function to pivot the motor 41.

By counterbalancing the weight of the motor 41, more precise control of the motor's motion between locked and unlocked positions is achieved, thereby allowing the motor 41 to move from stop to stop in a smooth motion without hard impact that might damage the motor 41 or door components. Further, helper spring 44 allows the motor 41 to rotate completely to the unlocked position when operating lightweight garage doors that are balanced to the open position with very low force.

Optionally, to protect the motor 41 as it approaches an upright position, a bumper 46, which may be constructed of an elastomeric material, may be attached to the operator framework 37 to cushion any contact between the motor 41 and operator framework 37. As shown, bumper 46 may be attached as by a clip 47 to a flange 48 that extends rearwardly and downwardly from the operator framework 37. Further, by limiting the motion of the operator motor 41 between these positions, the operator motor 41 is generally located at the level of the axle 27 or just below the axle 27, such that only a small portion of the operator housing 36 extends above the axle 27, thereby minimizing the amount of head room required by the operator system 35. In essence, the operator system 35 resides below and within the envelope defined by the counterbalance system 25 and track assemblies 15.

Figure 3:
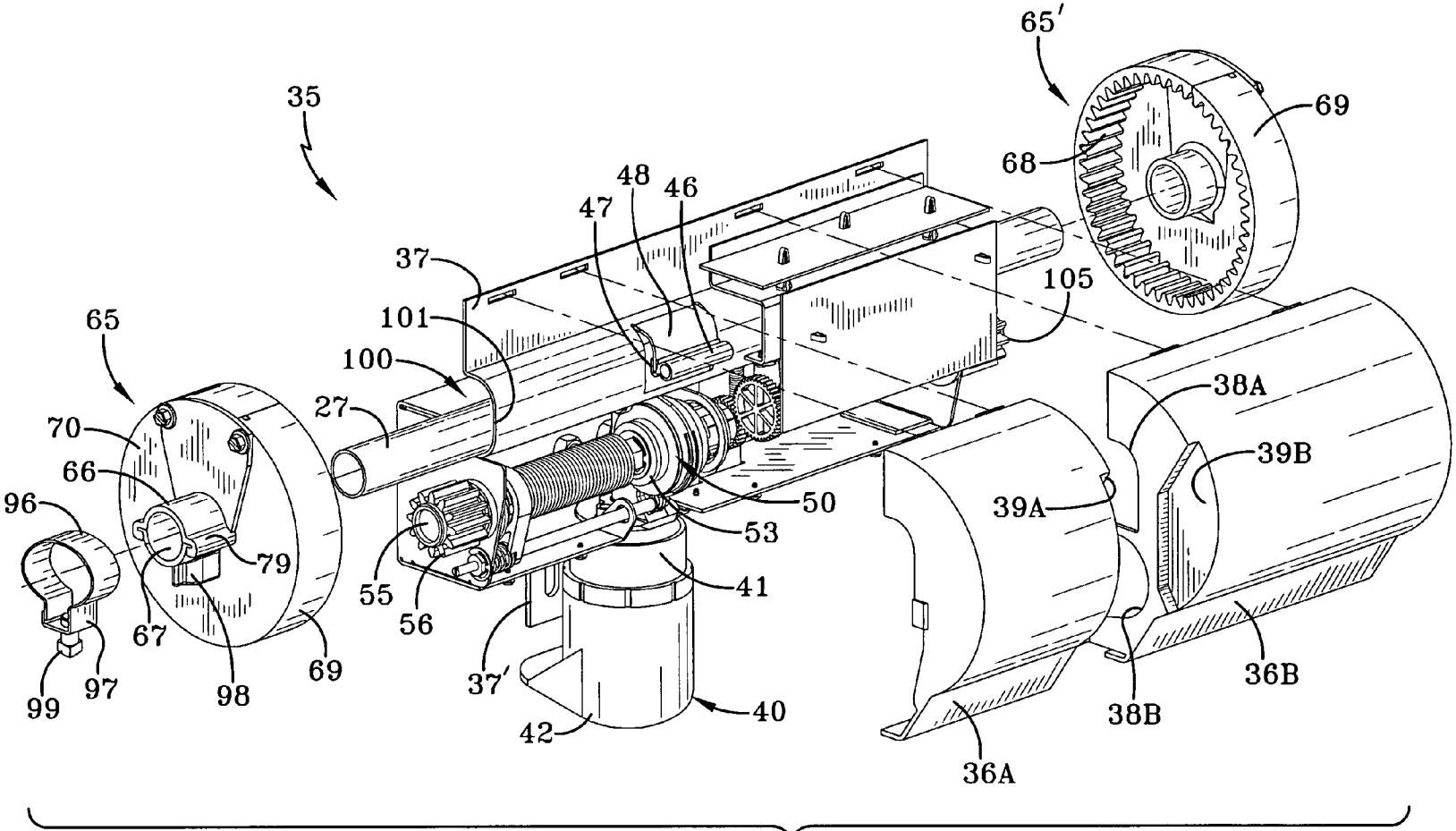
FIG. 3 is an enlarged exploded perspective view similar to FIG. 2 showing details of the operator.
Figure 4:
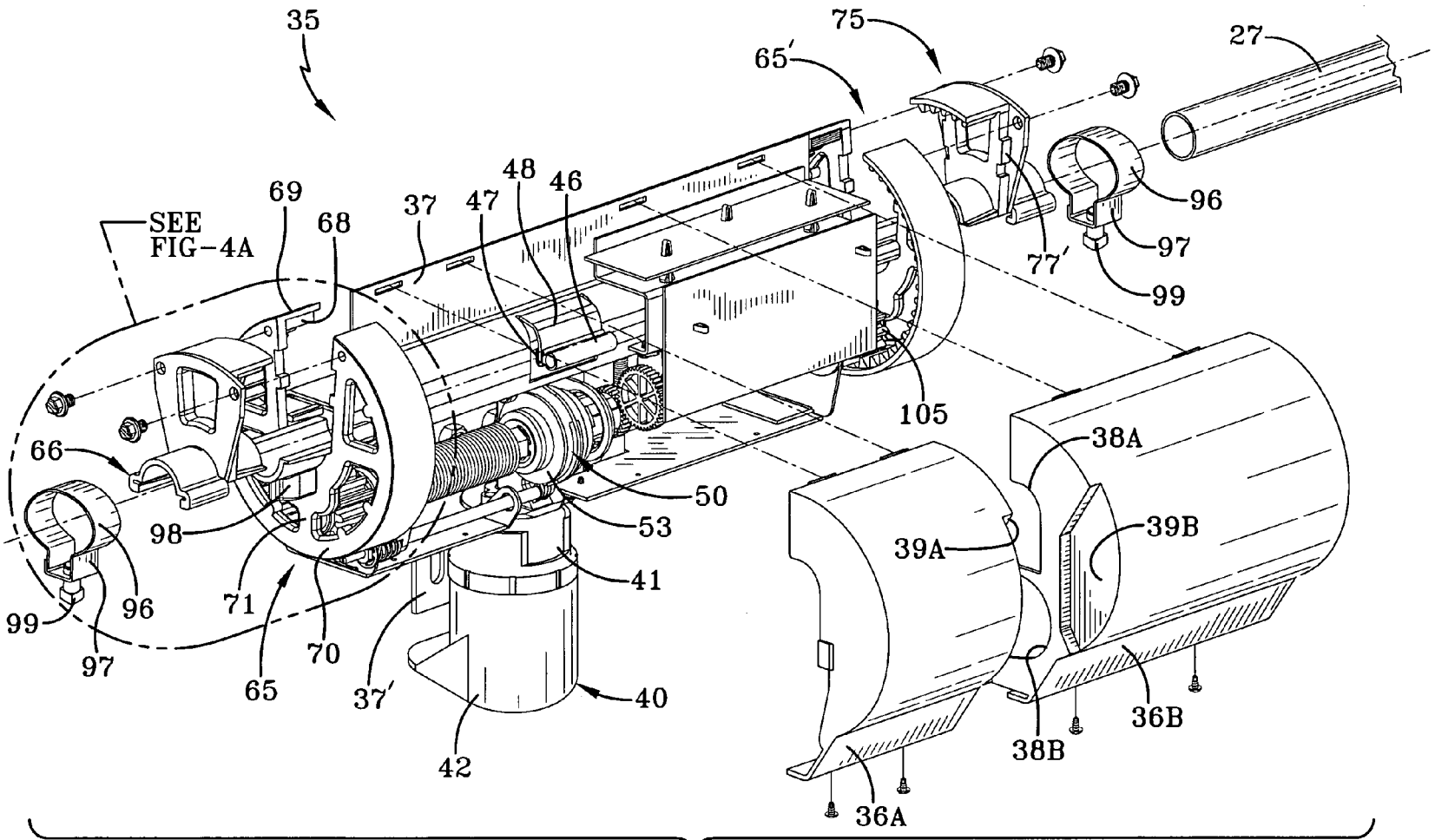
FIG. 4 is an exploded perspective view similar to FIG. 3 with the axle removed and the end gear assemblies dismantled to show additional details of the operator system.

Referring particularly to FIGS. 3-5, operator 35 includes a drive train enclosure, generally indicated by the numeral 50, supported within the operator framework 37 adjacent the motor assembly 40. As shown, drive train assembly 50 may extend generally in a direction perpendicular to the axis of the motor assembly 40. The drive train enclosure 50 may include a hollow cylindrical gear box 51 that accommodates a worm 52, which is attached to or may be cut into the shaft of the motor 41. The drive train enclosure 50 also includes an open ended cylindrical journal 53 that seats internally thereof a worm wheel 54 that is at all times positioned in mating engagement with the worm 52 of electric motor 41. A drive shaft 55 extends axially outward from the worm gear 54 and has a drive gear 56 nonrotatably mounted thereon. As best shown in FIG. 5, the drive gear 56 may be mounted at a distal end of drive shaft 55 with a pivot control assembly, generally indicated by the numeral 57, carried on the drive shaft 55 located between the cylindrical journal 53 and the drive gear 56. The pivot control assembly 57 may be made in accordance with the concepts of the pivot control assembly disclosed in U.S. patent application Ser. No. 09/710,071, which was filed on Nov. 10, 2000 (a continuation-in-part of U.S. patent application Ser. No. 09/548,191, which was filed on Apr. 13, 2000), and is incorporated herein by reference.

In the depicted example, pivot control assembly 57 includes a threaded cylinder 58 and a cuff 59 that is internally threaded and mounted on the cylinder 58, such that rotation of the cylinder 58 causes axial movement of the cuff 59. As best shown in FIG. 3, cuff 59 includes a radially projecting portion 60 which is adapted to selectively displace a pivot control member 61. In the embodiment shown, the pivot control member 61 has a spring loaded plunger 62 that is supported at one end of the pivot control member 61 by the operator framework 37. The plunger 62 is slidingly received by the operator framework 37, such that the cuff 59 is able to displace the pivot control member 61 upon contacting the plunger 62. A spring 63 is engageble with the plunger 62 and operator framework 37 to urge the pivot control member 61 toward an engaged position where the pivot control member 61 locks pivotal movement of the operator motor assembly 40. As best shown in FIG. 5, in the engaged position, pivot control member 61 extends over motor 41 to block pivotal movement of the motor assembly 40. In the disengaged position (not shown), the pivot control member 61 is retracted allowing the motor assembly 40 to pivot. As described above, motor assembly 40 urges the door D upward or downward by interacting with the counterbalance system 25 to cause rotation thereof. In the example shown, this interaction begins with the worm 52 driving the worm gear 54 to cause rotation of the drive shaft 55 and, in turn, drive gear 56. The motor assembly 40 is interconnected to axle 27 by a gear assembly, generally indicated by the numeral 65, that is rotatably fixed to the axle 27, such that the axle 27 rotates with the gear assembly 65.

In the embodiment shown, a pair of gear assemblies 65 is provided at either end of the operator 35. It will be appreciated that only a single gear assembly 65 may be used. Similarly, only a single gear assembly 65 needs to be driven. In the example shown, the gear assembly 65' is driven by axle 27. Further, while gear assemblies 65, 65' are shown at the axial extremities of the operator 35, it will be understood that such assemblies may be located at intermediate positions within operator 35, as well. Since the gear assemblies 65, shown, have generally the same structure, the description will proceed with reference to a single gear assembly 65.

Figure 4A:
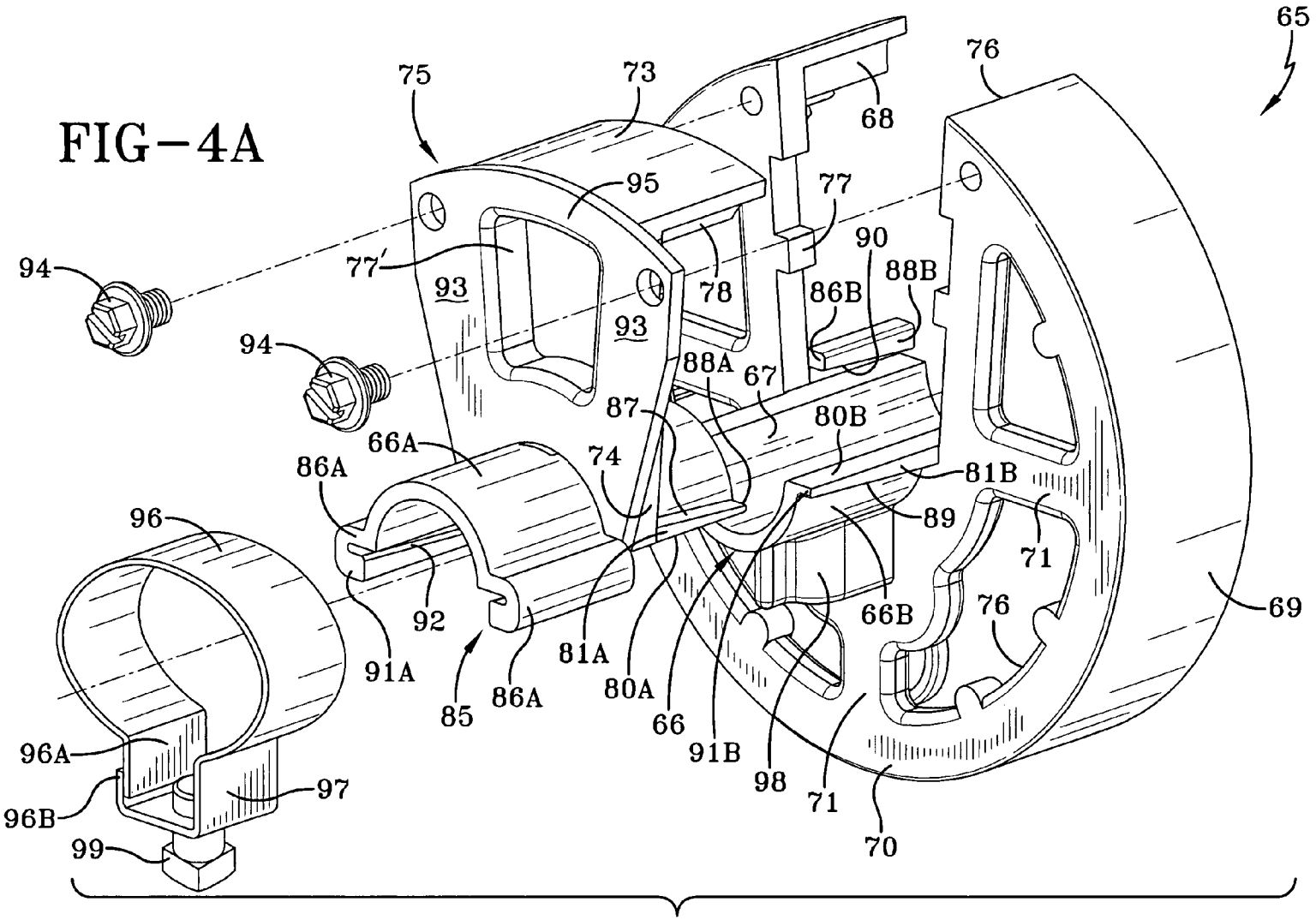
FIG. 4A is a further enlarged perspective view of the area of the operator indicated in FIG. 4 showing details of the gear assembly and removable gear segment that is adapted to radially receive the axle and secure the axle within the bore of the gear assembly.

With reference to FIG. 4, it may be seen that gear assembly 65 is generally wheel-like in form, having a hub, generally indicated by the numeral 66 defining a bore 67 through which the axle 27 is received. At its periphery, gear assembly 65 includes a gear surface 68 adapted to mate with the drive gear 56, such that motor assembly 40 may cause rotation of the gear assembly 65. The gear surface 68 may be formed externally on the gear assembly 65, such that the drive gear 56 would be located on the outside of the gear assembly 65 or, as in the example shown, the gear surface 68 may formed internally. With the gear surface 68 formed internally, drive gear 56 is housed within the gear assembly 65 reducing the likelihood of entrapment of articles between the drive gear 56 and gear surface 68. As best shown in FIG. 4, gear surface 68 is supported on a generally cylindrical rim 69 that is supported in spaced relation from the hub 66 by an end wall 70, which may be solid, as shown in FIG. 3, or skeletal, as shown in FIG. 4A, where the end wall 70 includes radially extending support members 71 that define openings 72 therebetween. Therefore, reference to "end wall" 70 encompasses any member or members that support the rim 69 on hub 66.

As best shown in FIGS. 4 and 4A, a portion of the rim 69, gear surface 68 and hub 66 is made removable for opening the gear assembly 65 to create a radial slot allowing insertion of the axle 27 without having to disassemble the counterbalance system 25. In particular, the hub 66 is divided into two halves 66A, 66B with one of the halves being removable to open the entire diameter of the bore 67. It will be appreciated that if the bore 67 is larger than the axle 27, with which the operator 35 is used, a smaller portion of the hub 66 may be made removable. Similarly, a portion of the rim 69 sufficiently large enough to receive axle 27 is made removable, such that the axle 27 may pass through the rim 69 and be received in the hub half 66B that remains attached to the end wall 70. It will be appreciated that the rim 69 and hub 66 may be removed and reassembled separately. In the example depicted in the figures, the removable portion 73 of rim 69 and removable hub half 66A may be joined by a removable portion 74 of end wall 70, such that the removable portion 73 of rim 69 and removable hub half 66A are simultaneously removed or reassembled. For purposes of simplicity, the removable hub half 66A, removable portion 73 of rim 69, and removable portion 74 of end wall 70 will be collectively referred to as a removable gear segment, generally indicated by the numeral 75 in the accompanying drawings.

As best shown in FIG. 4A, the removable gear segment 75 is generally adapted to be removed and assembled in an axial direction. To help insure proper fit of the removable gear section 75 and to help reinforce the interconnection of the gear section 75 and end wall 70, end wall 70 may be provided with one or more projections 77 that interlock with correspondingly formed axial projections 77' in the removable portion 74 of end wall 70. The removable portion 73 of rim 69 is sized and contoured to fill the gap 76 formed in the rim 69 and includes a gear portion 78 of gear surface 68 that coincides with the gear surface 68 on either side of the gap 76, such that an uninterrupted gear surface 68 is provided when the removable gear section 75 is assembled.

In regard to the hub 66, the hub halves 66A, 66B have opposed mating surfaces 80A, 80B along the seam 79 (FIG. 3) of the hub 66. To provide for clamping engagement of the axle 27 within the hub 66, the hub halves 66A, 66B may be provided with diametrically opposed and laterally extending lips 81 formed at the hub seams 79 FIG. 4A).

Various clamping means may be provided to apply a clamping force to the lips 81 including clips or fasteners. In the embodiment shown, the hub 66 is provided with an integral clamping assembly, generally indicated by the numeral 85. Due to the separation of the hub 66 into halves, the clamping assembly 85 is similarly divided and includes first and second receivers 86A, 86B respectively formed on the axial outward side of removable hub half 66A and the axial interior side of fixed hub half 66B. As shown, lips 81A, 81B are respectively found on the axial interior side of removable hub half 66A and on the axial outward side of fixed hub half 66B, such that the lips 81A formed on the removable hub half 66A are slidingly received within receiver 86B upon insertion of the removable hub half 66A. At the same time, lips 81B are received in the receiver 86A formed on the outer axial side of the removable hub half 66B. To provide a clamping force, the lips 81 and receivers 86 are provided with a taper that expands from the axial extremity toward the plane of the end wall 70. In particular, the lips 81A on removable hub half 66A and upwardly facing surface 87 slopes upwardly from the axial internal extremity 88A of hub half 66A toward the removable portions 74 of the end wall 70. Similarly, the receiver 86B has a downwardly facing surface 89 that slopes upwardly from its axial internal extremity 88B toward the end wall 70. The slopes of the upwardly facing surface 87 and downwardly facing surface 89 on hub halves 66A, 66B are substantially the same. Insertion of the lips 81A into receiver 86B causes the lips 81A, 81B to increasingly be forced against each other as the removable gear section 75 is axially inserted by the corresponding slopes of surfaces 87, 89. In the same fashion, lips 81B have a downwardly facing surface 89 extending downwardly from the axial outer extremity 91B of hub half 66B toward the end wall 70. A similarly sloped upwardly facing surface 92 is formed on the interior of receiver 86A. Consequently, axial insertion of the gear section 75 will likewise draw the lips 81B and receiver 86A together. In this way, the sloped surfaces 87, 89, 90, 92 draw the hub halves 66A, 66B together to clamp the axle 27 within bore 67.

Once the removable gear section 75 is inserted, further attachment may be provided by fastening the gear section 75 to the end wall 70. To that end, laterally extending tabs 93 may be provided to overlap a portion of the end wall 70 to facilitate attachment, as by fasteners 94. As shown, tabs 93 may form part of a backing member 95 which my conveniently provide further support for the removable portions of rim 69, end wall 70 and hub portions respectively 73, 74, 66A.

As an alternative or in addition to interlocking hub halves 66A, 66B together, a locking collar 96 may be provided to clamp the halves 66A, 66B. As shown, locking collar 96 is sized to fit over the axially outward extending portion of hub 66. The collar 96 may be a band of material that may be stretched open at overlapping ends 96A, 96B of collar 96 (FIG. 4A). In the embodiment shown, upturned second end 96B forms a catch for a releasable first end 96A. Collar 96 may further define a radially outward extending portion 97 which may be rectangular in section, defining an opening adapted to receive a projection 98 formed on one of the hub halves 66A, 66B. In the example shown in FIG. 4, projection 98 extends downwardly from the fixed hub half 66B. Projection 98 provides a bearing surface for a locking fastener 99 that is used to cause collar 96 to apply a clamping force to the hub 66. Projection 98 may be provided with a threaded bore (not shown) for receiving the locking fastener 99. The bore may extend through the hub half 66B such that the fastener 99 may bear on the axle 27. As will be understood, when the collar 96 is not used (FIG. 2), fastener 99 may be threaded into projection 98 to apply a clamping force to axle 27.

To assemble the operator 35 on an existing axle 27, the operator framework 37 may be generally L-shaped and define a clearance 100 for receipt of the axle. In this example, operator framework 37 may be slid behind the axle 27 and then fastened to the header 13 by mounting bracket 37'. Optionally, the operator framework 37 may include a channel 101 that defines clearance 100 within the operator framework 37. Channel 101 may have a generally U-shaped profile that opens toward the header 13. In this example, the operator framework 37 is slid upwardly and inwardly to seat the axle 27 within the channel 101. After insertion of axle 27, the operator framework 37 may be fastened to the header 13 in a normal fashion. To mount the operator 35 on an existing counterbalance system 25, the removable gear sections 75 are removed from gear assemblies 65, 65' prior to installing the operator 35 on the header 13. In this way, the axle 27 may be received within the gear assembly 65 by raising the operator assembly 35 from below the axle 27 and guiding the operator 35 such the axle 27 drops within the gap 78 in the gear assembly 65. With the axle 27 properly located within the gear assembly 65 and clearance 100, the operator framework 37 may be fastened to the header 13. Then the removable gear section 75 may be axially inserted over the top half of the axle 27 to trap the axle 27 within gear assembly 65, effectively coupling the axle 27 and motor 41. As necessary, locking collars 96 may be attached at the axial outward ends of the gear assembly 65. At this point, the axle 27 is interconnected with the motor assembly 40, such that the motor assembly 40 can cause rotation thereof and control travel of the door D between the open and closed positions.

Thus, it should be evident that the overhead door operator system disclosed herein carries out one or more of the objects of the present invention set forth above and otherwise constitutes an advantageous contribution to the art. As will be apparent to persons skilled in the art, modifications can be made to the preferred embodiment disclosed herein without departing from the spirit of the invention, the scope of the invention herein being limited solely by the scope of the attached claims.

The invention claimed is:

1. An operator used in connection with a door having a counterbalance system including an axle, comprising, a motor assembly, a gear assembly operatively interconnected with said motor assembly such that said motor assembly causes rotation thereof, a bore in said gear assembly adapted to receive the axle which is rotatable with said gear assembly and a gear segment of said gear assembly that is removable to radially open said gear assembly and allow insertion of the axle into said bore, wherein said motor assembly includes a rotatable drive gear engageable with a gear surface formed on said gear assembly, wherein said gear assembly includes an outer rim, said gear surface being formed interiorly of said rim and said drive gear engaging said gear surface interiorly of said rim.

2. The operator of claim 1, wherein said rim extends axially inward to an extent substantially the same as or greater than an axial extension of said drive gear, whereby said drive gear is housed within said gear assembly.

3. The operator of claim 1, wherein said gear segment is slidingly received within said gear assembly, and is removable in a direction parallel to the axle.

4. The operator of claim 3, wherein said gear assembly includes a hub defining said bore, a rim spaced radially from said hub, and a gear surface formed on said rim and engageable with a drive gear associated with said motor and rotatable therewith, wherein said gear segment includes a rim portion, a gear portion formed on said rim portion, and a hub portion, wherein said rim portion and said hub portion are removable with said gear segment.

5. The operator of claim 4, wherein said hub is divided into a first half and a second half, said first half forming said removable hub portion and interconnected with said rim portion by a wall portion, whereby said gear segment may be removed in a unitary fashion.

6. The operator of claim 5, wherein said gear segment is selectively attached to said gear assembly by a fastener.

7. The operator of claim 6, wherein said gear segment includes a laterally extending tab that overlaps a portion of said gear assembly, wherein said gear segment is attached at said tab.

8. The operator of claim 7, wherein said gear segment includes a backing plate extending radially between said rim portion and said first hub half and spaced axially outward of said rim, wherein said tab extends laterally from said backing plate.

9. The operator of claim 8, wherein a pair of tabs extend from said backing plate and wherein a pair of fasteners extends through said tabs into said gear assembly to attach said gear segment thereto.

10. The operator of claim 9, further comprising means for clamping said first and second halves of said hub together.

11. The operator of claim 10, wherein said means for clamping said halves of said hub together includes a lip carried on at least one of said halves of said hub and a receiver formed on the other of said halves of said hub defining a slot extending in the axial direction for receipt of said lip.

12. The operator of claim 11, wherein said lip has an outwardly facing surface that slopes inwardly as said lip extends outwardly from said one of said halves of said hub in the axial direction, and wherein said receiver has an inwardly facing surface having substantially the same slope as said outwardly facing surface on said lip, wherein said surfaces are engageable upon insertion of said lip in said receiver.

13. The operator of claim 10, wherein said means for clamping said halves of said hub together includes a pair of lips extending axially inward from said first half of said hub and a pair of receivers supported on said second half of said hub located axially inward of a radially extending end wall on said gear assembly, said receivers defining axially extending slots adapted to receive said pair of lips on said first half of said hub.

14. The operator of claim 13, wherein said means for clamping further comprises a second pair of lips extending axially outward from said second half of said hub and a pair of receivers supported on said first half of said hub and located axially outward of said end wall, said receivers defining slots adapted to receive said second pair of lips on said second half of said hub upon insertion of said gear segment.

15. The operator of claim 14, wherein said lips have outwardly facing surfaces that are tapered inwardly as the lips extend axially outward from said end wall, and said receivers have inwardly facing surfaces that taper inwardly as they extend axially outward from said end wall, said inward facing surfaces of said receivers and said outward facing surfaces of said lips being engageable upon insertion of said gear assembly.

16. The operator of claim 15 further comprising, a locking collar slidingly received over at least one of said first and second halves of said hub and fastenable to said end wall.

17. The operator of claim 16, wherein said end wall carries an axially outward extending projection and wherein said locking collar includes a radially extending portion adapted to fit over said projection upon sliding said clamping ring over said hub.

* * * * *